United States Patent [19]

Nauheimer et al.

[11] 4,318,472

[45] Mar. 9, 1982

[54] GARMENT HANGER BOX

[75] Inventors: James F. Nauheimer, Chicago; Gregory G. Julich, Carol Stream, both of Ill.

[73] Assignee: Container Corporation of America, Chicago, Ill.

[21] Appl. No.: 221,348

[22] Filed: Dec. 29, 1980

[51] Int. Cl.[3] ..... B65D 85/18

[52] U.S. Cl. ..... 206/284; 206/289; 206/292

[58] Field of Search ..... 206/284, 285, 289, 290, 206/291, 292, 299

[56] References Cited

U.S. PATENT DOCUMENTS

| | | | |
|---|---|---|---|
| 1,238,344 | 8/1917 | Rutledge | 206/284 |
| 1,662,819 | 3/1928 | Cave | 206/284 |
| 2,132,246 | 10/1938 | Shapiro | 206/284 |
| 3,687,277 | 8/1972 | Spencer et al. | 206/284 |
| 4,085,842 | 4/1978 | Beck | 206/289 |

*Primary Examiner*—Joseph Man-Fu Moy

*Attorney, Agent, or Firm*—Richard W. Carpenter; Davis Chin

[57] ABSTRACT

A garment hanger box formed from a unitary sheet of foldable paperboard to form a pair of connected telescoping tray sections, one of which has an end wall which is slotted to receive a hanger hook, the other of which has a cooperating end wall provided with an aperture which locks with the hook of the hanger to hold the hanger in position.

1 Claim, 4 Drawing Figures

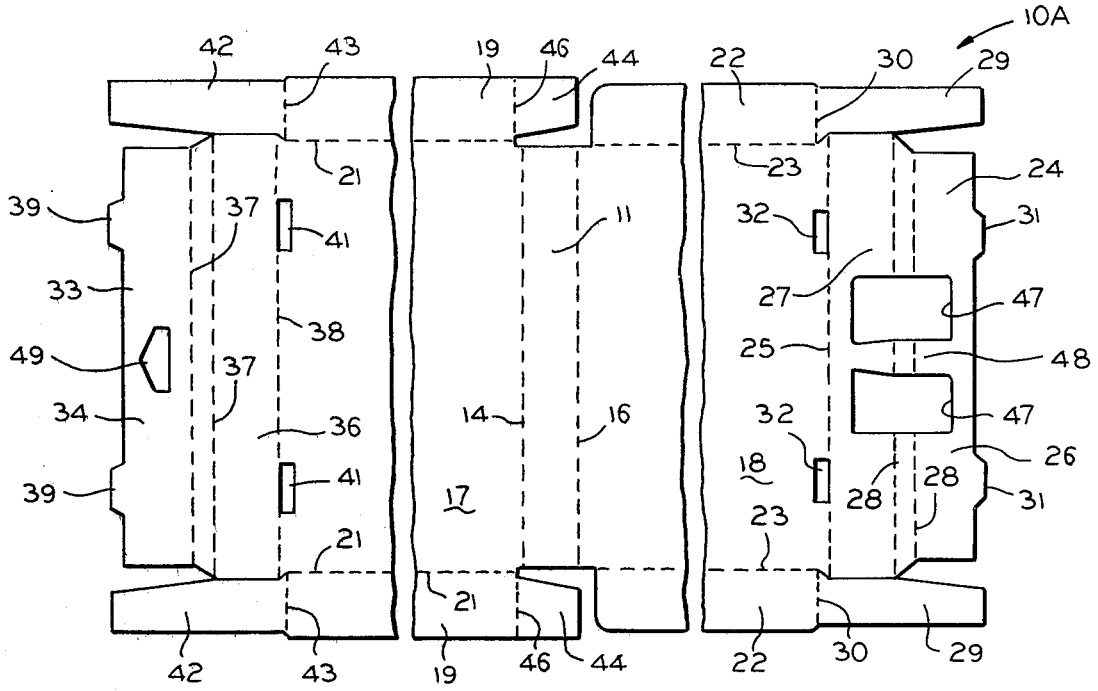
FIG. 1
FIG. 2
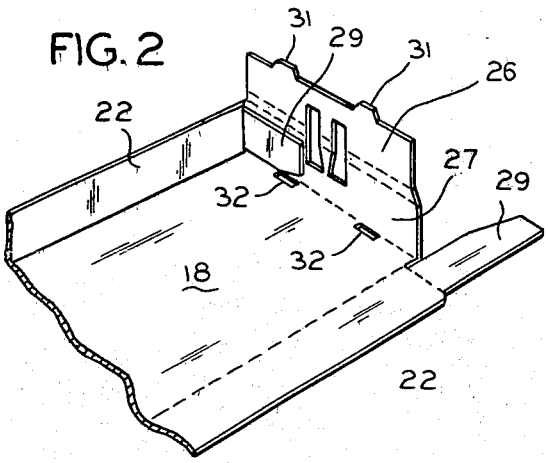
FIG. 3
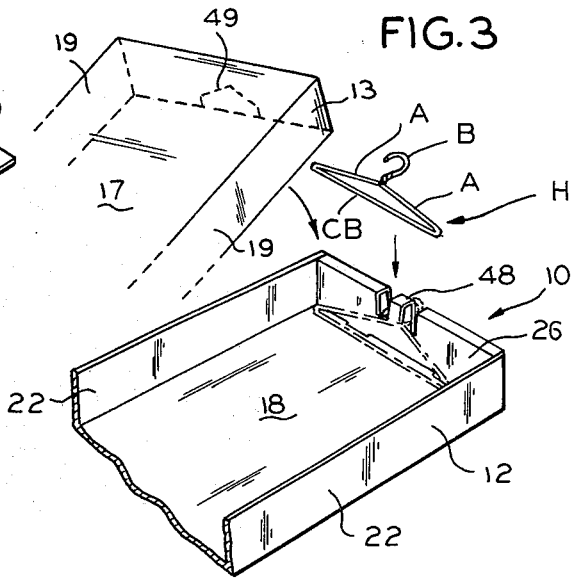
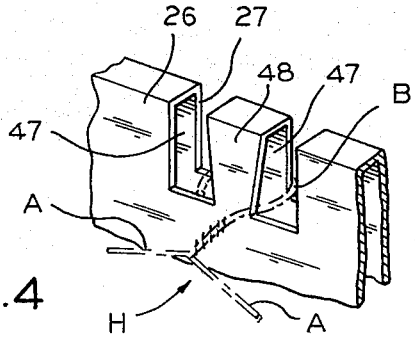
FIG. 4

GARMENT HANGER BOX

SUMMARY OF THE INVENTION

The invention structure relates to garment boxes employed to hold and transport one or more garments each being carried on a hanger.

The invention structure comprehends the provision of a box formed from a paperboard blank into a pair of telescoping trays having a common bottom wall and facing top walls, one of which has slots therein for a hooked hanger, the other having a locking aperture therein in engagement with the hook of the hanger.

THE DRAWING

FIG. 1 is a plan view of a cut and scored blank for forming a garment hanger box according to the present invention;

FIG. 2 is an isometric view showing a step in folding the blank of FIG. 1;

FIG. 3 is an isometric view showing a further step in forming a box according to the invention; and FIG. 4 is a detailed isometric view showing structure for holding a garment hanger in position.

The garment hanger box is denoted by the reference numeral 10 and is formed from a cut and scored blank 10A of paperboard.

Box 10 and blank 10A have a generally rectangular narrow common bottom wall 11 flanked by a lower tray section 12 and an upper tray section 13, the sections 12 and 13 being in telescoping relationship, and being folded with respect to each other about the common wall 11.

Container 10 is adapted to enclose a hanger H having a curved hook B, connected to arms A, the distal ends of which have extending therebetween crossbar CB.

Tray section 13 includes a side wall 17 connected to bottom wall 11 at score line 14. Side wall 17 has opposed end walls 19 foldable with respect thereto along fold lines 21.

Tray section 12 includes a side wall 18 connected to bottom wall 11 at score line 16. Side wall 18 has opposed end walls 22 foldable with respect thereto along fold lines 23.

Tray section 12 includes an inner top wall 24 consisting of top wall forming panels 26 and 27 joined to each other along spaced lines 28, panel 27 being joined to side panel 18 along a fold line 25. In forming tray section 12 tuck flaps 29 connected to end walls 22 are folded along fold lines 30 between panels 26 and 27, and Walker tabs 31 are locked into Walker slots 32 formed in side panel 18 near fold line 25.

Tray section 13 includes an outer top wall 33 consisting of top wall forming panels 34 and 36 joined to each other along spaced score lines 37, panel 36 being joined to side wall 17 along a fold line 38. Walker tabs 39 are engaged in Walker slots 41 in side wall 17, and in forming tray section 13 dust flaps 42 connected along fold lines 43 to end walls 19 are held between the panels 34 and 36.

In the closing of tray 13 into position over tray 12 flaps 44 foldable with respect to end walls 19 are brought into position over bottom wall 11.

Structure is provided holding and locking hanger H in position within container 10. To this end panels 26 and 27 are intersected by spaced slots or apertures 47 forming therebetween upon folding of panels 26 and 27 to position a post 48. The hook B of hanger H is curved about the post as seen in FIGS. 3 and 4.

Tray portion 13 is provided with structure bearing against hook B, and top wall forming panel 34 is provided with a locking aperture 49 configured as shown adapted to receive hook B and restrain same against movement from around post 48.

We claim:

1. In a one piece garment container fromed from a unitary blank of foldable paperboard including a pair of telescoping sections for holding therein a garment on a hanger having a hook, the combination of:

(a) generally rectangular, relatively narrow common bottom wall;

(b) a pair of tray-like sections foldably joined to said bottom wall and disposed for telescoping relation one within the other, each of said sections including:

i. a side wall;

ii. a pair of opposed end walls;

iii. a top wall;

iv. and said common bottom wall;

(c) said top wall of one of said sections being comprised of a pair of top wall forming panels folded into confronting relationship, the inner one of said panels being secured to a side wall;

(d) a pair of spaced slots formed in said top wall forming panels, said slots forming there between a post to receive the curved hook of said hanger;

(e) the top wall of the other of said sections being comprised of a pair of second top wall forming panels folded into confronting relationship, the inner one of said panels being secured of a second side wall;

(f) a locking aperture formed in the inner one of said second top wall forming panels and falling into register with said spaced slots and the hook of said hanger to hold the same against movement from around said post.

* * * * *